United States Patent [19]

Robbins, deceased et al.

[11] 4,050,674

[45] Sept. 27, 1977

[54] HYDRAULIC JACK

[75] Inventors: Joseph Henry Robbins, deceased, late of Birmingham, England, by George Trevor Palfreyman and Roger Jerome Guy, executors; John Edward Acton, Willenhall, England

[73] Assignee: Tangye Limited, Birmingham, England

[21] Appl. No.: 754,214

[22] Filed: Dec. 27, 1976

[51] Int. Cl.[2] ..... B66F 3/24

[52] U.S. Cl. ..... 254/93 H; 90/23; 91/43; 91/401; 92/30

[58] Field of Search ..... 254/93 R, 93 H; 91/43, 91/401; 92/30; 90/23

[56] References Cited

U.S. PATENT DOCUMENTS

| | | | |
|---|---|---|---|
| 2,153,845 | 4/1939 | Rosenberry | 254/93 H |
| 2,839,032 | 6/1958 | Reynolds | 91/401 |
| 3,552,273 | 1/1971 | Resuggan | 92/30 |

*Primary Examiner*—Robert C. Watson

*Attorney, Agent, or Firm*—Ladas, Parry, Von Gehr, Goldsmith & Deschamps

[57] ABSTRACT

A hydraulic jack comprising a cylinder, a piston slidable relative to the cylinder, pump means to supply pressurized fluid to the base of the piston, a seal between the piston and the cylinder, means for limiting the stroke of the piston in the cylinder, said means comprising a ring carried by the piston and arranged to expand into a groove in the cylinder wall when the piston reaches the end of its permitted travel, and means for selectively de-activating said stroke limiting means, in order to allow removal of the piston from the cylinder to renew the seal.

7 Claims, 5 Drawing Figures

HYDRAULIC JACK

This invention relates to a hydraulic jack of the kind (hereinafter referred to as "of the kind specified") comprising a cylinder, a piston slidable relative within the cylinder, a pump for supply of fluid under pressure to an inlet in the cylinder to move the piston, a seal between the piston and the cylinder, and means for limiting the stroke of the piston in the cylinder by permitting fluid pumped into the cylinder, once the piston reaches the end of its permitted stroke, to escape from the cylinder to a zone of relatively low pressure, the stroke limiting means mechanically preventing removal of the piston from the cylinder.

Conventional jacks of the kind specified suffer from the limitation that although the means for limiting the stroke of the piston is satisfactory when the piston is under normal operating pressure, it is sometimes possible to overcome the limiting means if the pump is actuated to produce an abnormally high pressure. Moreover, with jacks of this kind, it is often difficult to renew the seal between the piston and cylinder due to the stroke limiting means preventing withdrawal of the piston from the cylinder. It has thus been necessary to dismantle a substantial part of the jack in order to remove the piston and replace the seal.

The object of the present invention is to provide an improved hydraulic jack of the kind specified in which the disadvantages mentioned are minimised or avoided.

According to the present invention there is provided a hydraulic jack comprising a cylinder, a piston slidable relative within the cylinder, an inlet in the cylinder, a pump for supply of fluid under pressure to said inlet to move the piston, a seal between the piston and the cylinder, means for limiting the stroke of the piston in the cylinder by permitting fluid pumped into the cylinder, once the piston reaches the end of its permitted stroke, to escape from the cylinder to a zone of relatively low pressure, said stroke limiting means comprising an element carried by one of the piston and the cylinder and urged towards a position in which it engages in a recess or groove in the other of the piston and the cylinder positively to prevent further movement of the piston at said end of said permitted stroke, said stroke limting means, when so activated, also mechanically preventing removal of the piston from the cylinder, and means for selectively de-activating said stroke limiting means in order to allow said piston to be withdrawn from the cylinder, said de-activating means being a device operable to prevent said element moving into engagement with said recess or groove when the piston reaches said end of said permitted travel.

The invention will now be described by way of example with reference to the accompanying drawings in which.

Figure 1:
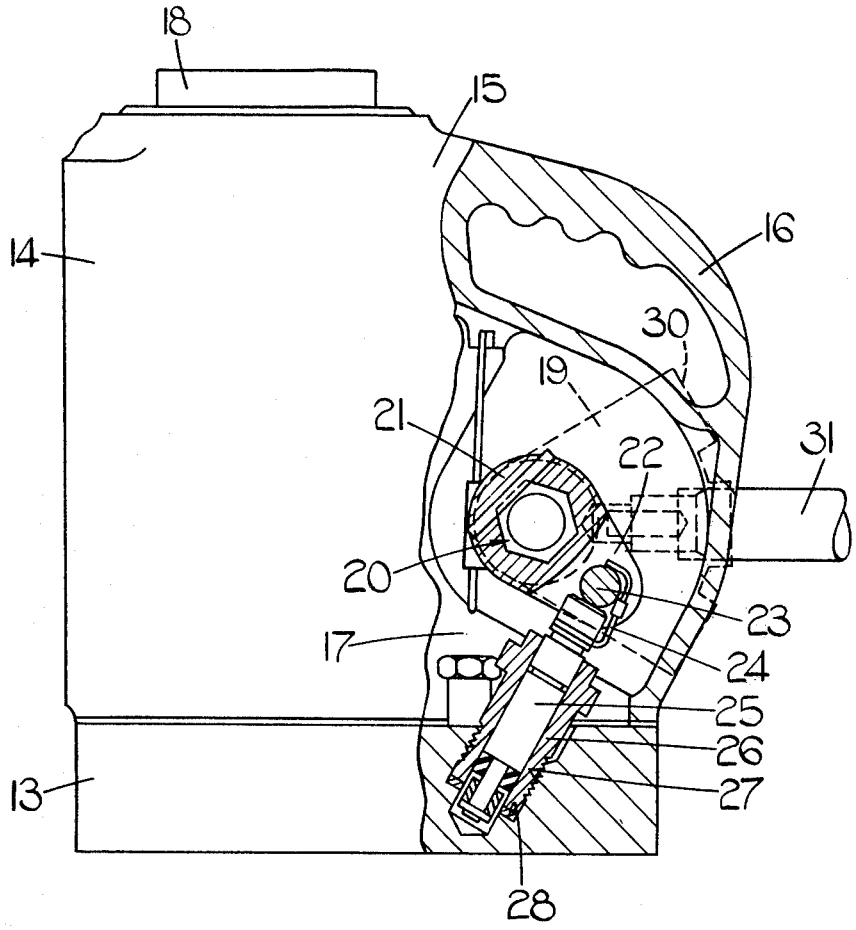
FIG. 1 is a part sectional side view of a hydraulic jack constructed in accordance with the present invention.

FIG. 1 is a part sectional side view of a hydraulic jack of the present invention. The jack comprises a hollow cylinder 10 accommodating a piston 11, incorporating a peripheral seal 12 and anti-extrusion ring **12*a* at its lower end. The components 10 to 12*a* are all shown in FIG. 2. The cylinder 10 is closed at its lower end by a base 13, shown in plan in FIG. 3. The cylinder 10 is enclosed in an outer casing 14 of the jack, the casing having a cylindrical portion 15 around the cylinder 10 and a handle portion 6 (FIG. 1) extending therefrom. The casing 10 is supported at the periphery of the base 13 and is fixed thereto by bolts (not shown). A chamber 17 is formed between the portion 15 of the casing the cylinder 10 and provides an oil reservoir. A cap 18 is detachably fitted onto the upper end of the piston 11**.

At one side of the handle portion 16, the casing is recessed to provide location for an element 19, of quadrant shape in the side view. The element 19 is one component of a pump assembly for pumping oil from the reservoir 17 to the base of the piston in order to raise it. The element 19 has a shaft 20 journalled in the casing and extending into the chamber 17. Fixed on the shaft 20 against rotation relative thereto is a tumbler 21. The tumbler has a pair of forks, one of which, 22, is shown in FIG. 1, and between the forks is held a roller 23 over part of which one end of a generally U-shaped clip 24 is engaged. The other end of the clip is attached to the head of a plunger 25 slidably disposed in a cylindrical casing 26 received in an opening 27 in the base 13. The opening 27 has a shoulder 28 against which the lower end of the casing 26 bears through a seal. Below the shoulder 28, the opening communicates with a passage 29 in the base 13 as will be described. The plunger 25 and casing 26 serve as a pump to force oil from the reservoir 17 into the cylinder in order to raise the piston 11. The pump is operated by way of pivotal movement of the element 19 which as can be seen in FIG. 1, is provided with three sockets 30 in its side face. A manual operating lever 31 is engageable in any one of the sockets 30 and once engaged the pump can be operated as will be described through angular movement of said lever 31.

Figure 3:
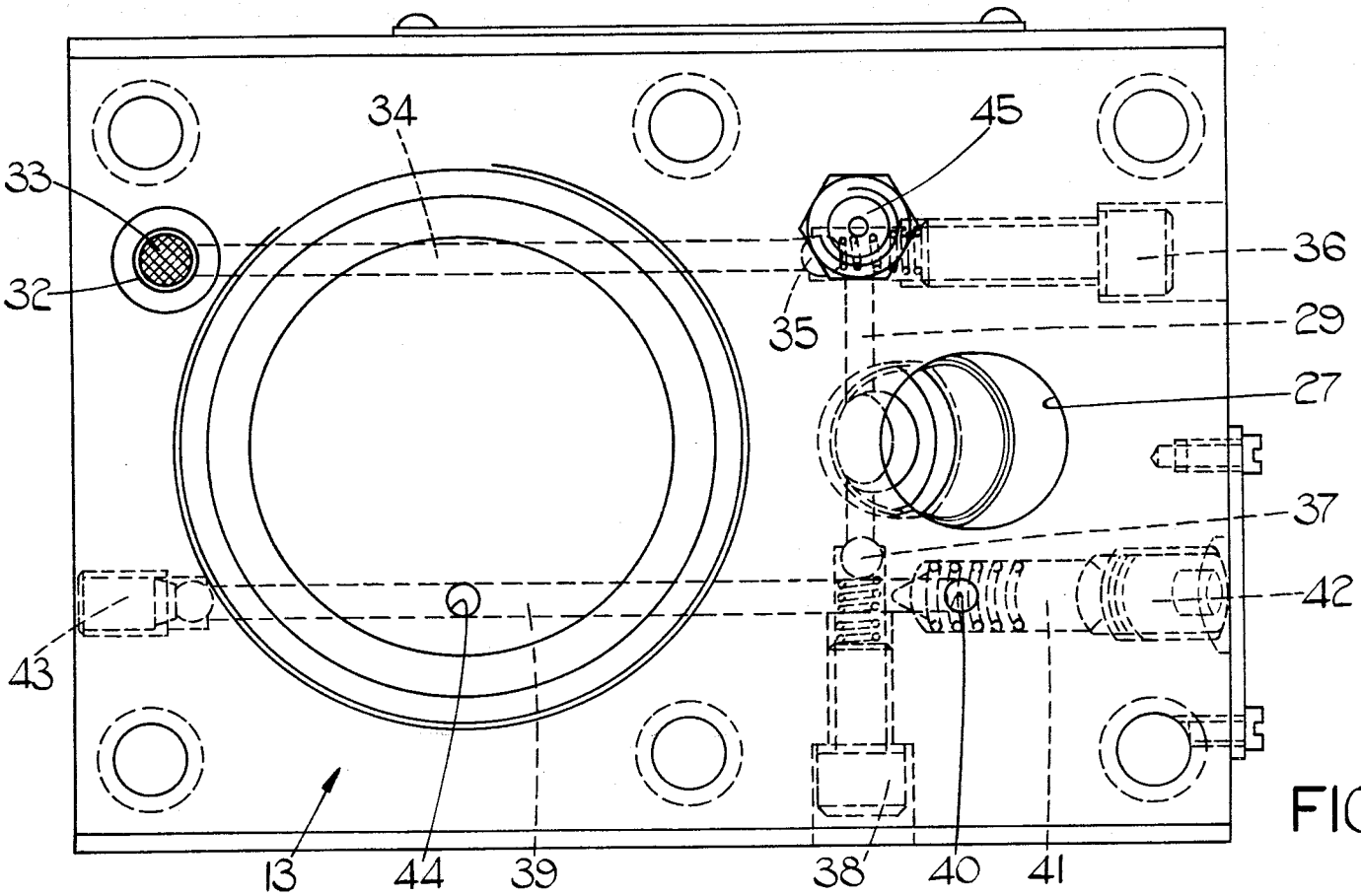
FIG. 3 is a plan view of the base of the hydraulic jack shown in FIG. 1, on an enlarged scale.

Referring to FIG. 3, the base 10 has an opening 32 with a filter 23 therein, the opening 32 being in communication with the reservoir 17 and leading to a passage 34 in the base 13. The passage 34 is stepped to provide a seat for a spring loaded ball 35, held in position by a screw 36. At a position behind the ball seat, the passage 34 joins the passage 29, which as already stated, communicates with the opening 27 in the base 13 which receives the pump arrangement. The passage 29 extends beyond the opening 27 and is like the passage 34, stepped to provide a seat for a spring loaded ball 37, with the associated screw 38. Behind the seat for the ball 37, the passage 29 communicates with a further passage 39 which extends parallel to the longer sides of the base and along substantially the whole length of the base. To one side of the passage 29, the further passage 39 has adjacent its one end, an opening 40 allowing communication with the reservoir 17. However, this opening is normally blocked by a spring release valve member 41 having an associated release screw 42. The other end of the further passage 39 is blocked by a ball and plug 43. The screws 36, 38 and 42 are all accessible from the exterior of the jack. Intermediate its ends, the further passage 39 is provided with an opening 44 into the chamber enclosed by the cylinder 10 above the base.

A passageway extending upwardly from the passage 34, at a position above the spring which loads the ball 35, leads to a conventional spring loaded pressure relief valve indicated generally at 45. This has the function of enabling the user to determine the maximum foce generated by the jack, to prevent overstressing, particularly where multiples of the jacks are used. It also prevents over pressurisation of the fluid in the cylinder by excessive force on the lever 31, thus preventing mechanical damage to the jack and particularly the seal 12.

Figure 2:
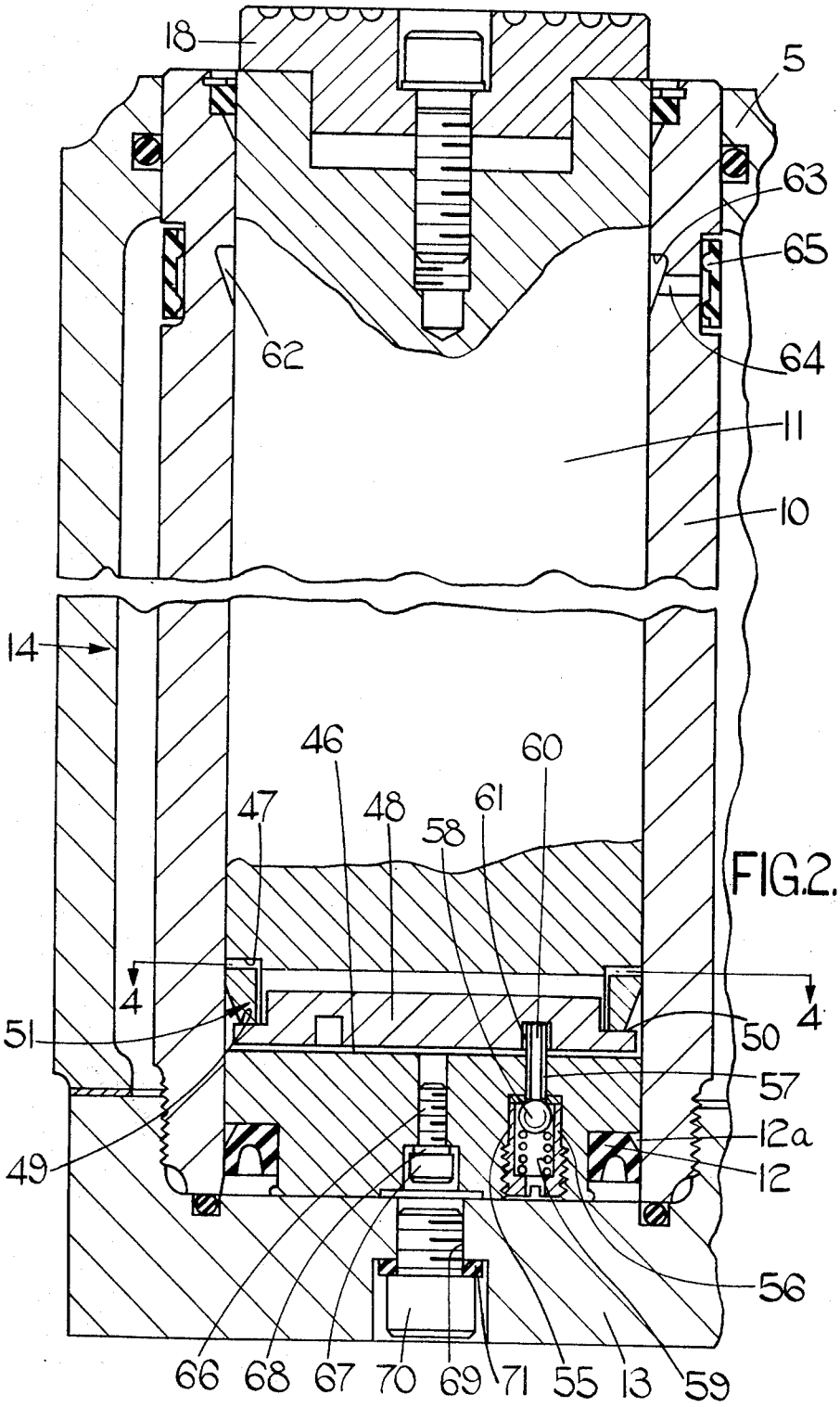
FIG. 2 is an enlarged sectional view of the part of the jack shown solid in FIG. 1.
Figure 4:
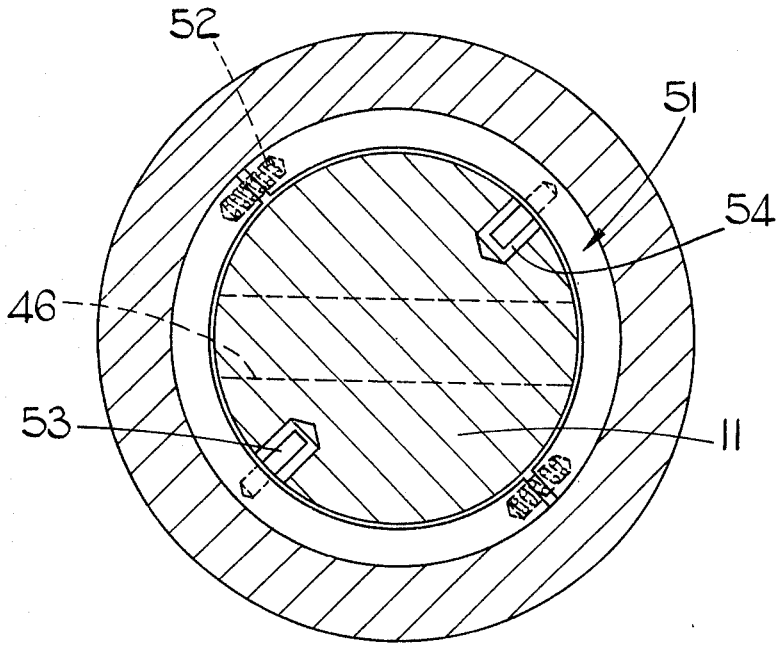
FIG. 4 is a cross-sectional view on the line 4—4 of FIG. 2.

As shown in FIG. 2, the piston 11 has a transverse, circular section, diametral through bore 46 with a circumferential groove 47 communicating therewith. A trip bar 48 is contained in the bore 46 and can move in a direction normal to the axis thereof. The bar has ledges 49, 50 at its respective ends and these provide seats for respective portions of a control ring 51 contained in the groove 47. The ring 51 is formed in two parts, as shown in FIG. 4, each part being of trapezoidal cross-section. The ends of each part are provided with respective blind bores and between adjacent ends of the parts there are provided respective coiled compression springs 52, the ends of which fit into said bores. Thus, when in the groove 47, the two parts of the control ring are spring loaded against the interior surface of the cylinder 10. Each part of the ring 51 has a bore in which an end of a retaining pin 53 fits. Each pin 53 extends radially from its associated ring into an oversize bore 54 in the piston 11, to permit a small amount of limited movement of the ring 51 axially of the piston 11.

The base of the piston is formed with an aperture 55 which is tapped for th reception of a screw threaded pressure release valve housing 56. The aperture 55 communicates with the bore 46 by means of a port 57, and a ball 58 is urged into closing engagement with the seat of the mouth of the port 57 by means of a compression spring 59 accommodated within the valve housing 56. A hexagonal section plunger 60 is accommodated within the port 57 and is supported at its lower end by the ball 58. The upper end of the plunger is received in a recess 61 in the lower surface of the bar 48, and is forced against the base of this recess, thereby urging the bar 48 off the bottom of the bore 46.

Near its upper end, the cylinder is provided in its interior surface with an annular groove 62. The groove 62 is generally, wedge shaped in cross section with its upper surface 63 normal to the axis of the cylinder 10. The cylinder is further provided with a radial hole 64 leading from the groove 62 to the oil reservoir. The hole 64 opens into a shallow external peripheral groove in the cylinder and a rubber garter seal 65 encircles the cylinder and is accommodated in the peripheral groove so as to close the radial hole 64 against ingress of fluid from the reservoir 17, whilst allowing fluid under pressure to pass from the radial hole to the reservoir 17.

In the centre of the bottom face of the piston 11 is a small screwed stepped bore 66, plugged by a socket screw 67 and sealing washer 68. The bore 66 communicates with the bore 46 in the piston. Co-axial with the bore 66 and extending through the base 13 is a larger screwed stepped bore 69, plugged by a socket screw 70 and washer 71. The provision of the bores 66 and 69 will subsequently be explained.

Operation of the jack is as follows. With the piston in its lowest position, and the release screw 42 screwed fully in, operation of the lever 31 causes the plunger 25 to reciprocate in its casing 26 and act as a pump. The pumping action draws oil from the reservoir 17 through the filter 33 and into the passage 34. On the upstroke of the plunger, the pressure of oil in the passage 34 overcomes the force of the spring loading the ball 35 and it is lifted off its seating. Oil thus flows into the passage 29. On the down stroke of the plunger 25, the pressure of the oil in the passage 29 forces the ball 37 off its seating and the oil flows into the passage 39 and then through the opening 44 into the cylinder, thus forcing the piston to rise. This process will continue until the piston reaches a position where the groove 47 in the piston commmunicates with the groove 62 in the cylinder.

In this position the two parts of the control ring 51 which are spring loaded outwardly by the springs 52, are forced into the groove 62. As supply of oil to the cylinder is continued, the upper face of the ring 51 engages against the upper surface 63 of the groove 62. This engagement causes the ring 51 to press down on the bar 48, which in turn acts as a valve actuating member and depresses the plunger 60 of the valve in the housing 56 thereby forcing the ball 58 off its seating. Due to the opening of the ball valve, oil under pressure can flow through the aperture 55, port 57 and the through bore 46 into the groove 62. Thence the oil flows through the bleed hole 64 and forces the seal 65 outwardly from its engagement with the cylinder 10. Oil can thus flow into the reservoir 17. The loss of pressure on the lower face of the piston due to this escape of oil, causes the ram to descend until the ball 58 re-seats, further pumping causing the piston to rise again under full oil pressure and the process repeating. Thus, the ring 51 acts as a positive stop to ensure that when the piston reaches the end of its permitted stroke, any further oil pumped into the cylinder is returned to the oil reservoir, thereby, preventing the piston being pumped out of its cylinder. In which ever manner the lever is operated, at the end of the stroke of the piston, the ring 51 will always remain engaged in the groove 62 and thus provide a stop. To release the piston from its raised position, it is necessary to undo the release screw 42, which action results in the valve member 41 moving to uncover the opening 40 to permit oil under pressure below the ram and in passage 39 to flow through the opening 40 to the reservoir 17. The oil is prevented from passing the member 41 by means of a seal (not shown).

In conjunction with the positive stop arrangement, the jack is provided with means for easily replacing the seals 12 and **12*a* without the necessity of dismantling the complete jack. The removal and replacement of the seals 12 and 12*a* is carried out as follows. Firstly the piston is released to its lowermost position and release screw 42 is screwed in the direction as for raising. The socket screw 70 and washer 71 are removed from the base 13 of the jack and the cap 18 of the piston removed and a special handle (not shown) is fixed to the piston 11. The handle enables the piston to be held down while a socket wrench (not shown) is inserted through the bore 69 to engage the socket screw 67. The socket screw 67 and washer 68** are then withdrawn.

Figure 5:
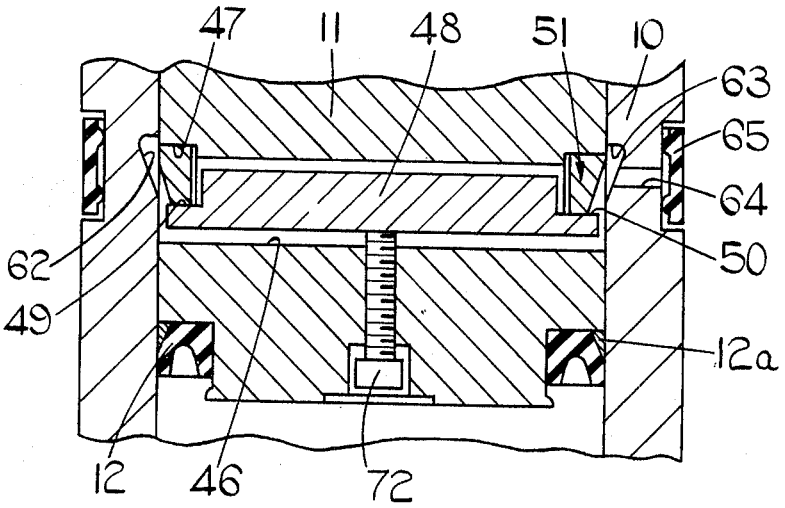
FIG. 5 is a fragmentary sectional view showing a portion of the jack shown in FIG. 2, with the stroke limiting means of the jack de-activated, the section being taken with the piston in the normally maximum stroke position.

A special long screw 72, FIG. 5, with an extended shank is then screwed into the bore 66 by means of the wrench until its end grips tightly against the lower face of the bar 48. The screw 72 is the same as the socket screw 67 except for its extended shank and its head fits in the larger diameter portion of the stepped bore 66 in the same way as the head of the screw 67.

The bar 48 is forced tightly against the control ring 51 by the screw 72 and the ring is clamped against the upper face of the groove 47. In this position the rings are locked tightly between said upper face and the respective ledges 49, 50 and are thus unable to spring out of the groove 47 when the groove 47 passes the groove 62 during upward travel of the piston.

The socket wrench is then withdrawn and the piston handle pulled to lift the piston out of its cylinder. The seals 12 and 12*a* can thus easily be removed and replaced, and the piston is ready for easy replacement into the cylinder once the seals have been renewed. The replacement of the screws 67, 70 is simply the reverse of the removal operation.

It is claimed:

1. A hydraulic jack comprising a cylinder, a piston slidable relative within the cylinder, an inlet in the cylinder, a pump for supply of fluid under pressure to said inlet to move the piston, a seal between the piston and the cylinder, means for limiting the stroke of the piston in the cylinder by permitting fluid pumped into the cylinder, once the piston reaches the end of its permitted stroke, to escape from the cylinder to a zone of relatively low pressure, said stroke limiting means comprising an element carried by one of the piston and the cylinder and urged towards a position in which it engages in a recess or groove in the other of the piston and the cylinder positively to prevent further movement of the piston at said end of said permitted stroke, said stroke limiting means, when so activated, also mechanically preventing removal of the piston from the cylinder, and means for selectively de-activating said stroke limiting means in order to allow said piston to be withdrawn from the cylinder, said de-activating means being a device operable to prevent said element moving into engagement with said recess or groove when the piston reaches said end of said permitted travel.

2. A hydraulic jack as claimed in claim 1, in which the element is a ring carried by the piston and arranged to expand into a groove in the cylinder wall when the piston reaches the end of its permitted travel, the de-activating means having screw means operable to clamp the ring with respect to the piston and prevent said expansion.

3. A hydraulic jack as claimed in claim 2, in which the piston is provided with a transverse bore communicating with an external circumferential groove, the ring being disposed in said groove and being supported by opposite ends of a bar disposed in said transverse bore, said bar being capable of movement in said bore in a direction axially of the piston, and there being a pressure release valve incorporated in the piston, the arrangement being such that unitl the piston reaches the end of its permitted travel, said release valve is closed, but when the piston reaches the end of its permitted travel, and said ring expands into said groove said bar is forced downwardly by the ring to open said valve thereby allowing fluid under pressure in the cylinder to escape from below the piston through said valve and said groove to a zone of relatively low pressure.

4. A hydraulic jack as claimed in claim 3, in which the piston has a threaded bore extending from its lower face into communication with said transverse bore, and a further threaded bore, co-axial with the bore in the piston, extends through a base of the jack, each of said threaded bores normally being blocked by a seal and a screw, the arrangement being such that, in use, with the piston in its lowermost position in its cylinder and both of said screws and seals removed, a screw with an extended shank can be inserted into said threaded bore in the piston and screwed until it clamps said bar against the ring to prevent outward expansion into engagement with said groove in the cylinder wall, thereby de-activating said stroke limiting means and allowing removal of the piston from the cylinder.

5. A hydraulic jack as claimed in claim 1 in which a base of the jack has a passage for conveying fluid from a reservoir, within the jack with which reservoir it communicates, to said pump, the passage having a one way restrictor valve which permits fluid to flow through said valve only on an upstroke of said pump and there being a pressure relief valve disposed in communication with said restrictor valve.

6. A hydraulic jack as claimed in claim 2 in which said ring is made of two halves, and between adjacent ends of the parts respectively are disposed springs to load the two halves apart.

7. A hydraulic jack as claimed in claim 6 in which each half is of trapezoidal cross-section.

* * * * *

UNITED STATES PATENT AND TRADEMARK OFFICE

CERTIFICATE OF CORRECTION

PATENT NO. : 4,050,674

DATED : September 27, 1977

INVENTOR(S) : Joseph Henry Hobbins, deceased; John Edward Acton

It is certified that error appears in the above-identified patent and that said Letters Patent are hereby corrected as shown below:

On the cover sheet, beneath "United States Patent", "Robbins, deceased et al." should read-- Hobbins, deceased et al.--.

On the cover sheet, left column, the inventor's name "Joseph Henry Robbins" should read-- Joseph Henry Hobbins--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*